US008448325B2

(12) United States Patent
Svensson et al.

(10) Patent No.: US 8,448,325 B2
(45) Date of Patent: May 28, 2013

(54) DRAWER DISHWASHER INSTALLATION KIT ASSEMBLY

(75) Inventors: Mats Svensson, Huskvarna (SE); Anders Berglund, Jönköping (SE)

(73) Assignee: Electrolux Home Products Corporation N.V., Brussels (BE)

( * ) Notice: Subject to any disclaimer, the term of this patent is extended or adjusted under 35 U.S.C. 154(b) by 637 days.

(21) Appl. No.: 12/596,561

(22) PCT Filed: Apr. 21, 2008

(86) PCT No.: PCT/EP2008/003172

§ 371 (c)(1), (2), (4) Date: Apr. 6, 2010

(87) PCT Pub. No.: WO2008/128736

PCT Pub. Date: Oct. 30, 2008

(65) Prior Publication Data

US 2010/0192350 A1 Aug. 5, 2010

(30) Foreign Application Priority Data

Apr. 19, 2007 (EP) ..... 07007969

(51) Int. Cl.
*B23P 11/00* (2006.01)
*F16M 11/00* (2006.01)

(52) U.S. Cl.
USPC ..... 29/525.02; 248/200

(58) Field of Classification Search
USPC ..... 29/505, 428, 11, 525.01, 525.02, 29/700; 248/200, 674, 675, 637; 211/26, 211/4; 16/221; 292/1.5
See application file for complete search history.

(56) References Cited

U.S. PATENT DOCUMENTS 4,239,781 A * 12/1980 Edwards ..... 514/723
7,360,659 B1 * 4/2008 Yoon et al. ..... 211/26

FOREIGN PATENT DOCUMENTS

| | | | |
|---|---|---|---|
| CA | 2551977 | | 2/2007 |
| DE | 3707977 | * | 4/1988 |
| DE | 29621598 | U1 | 2/1997 |
| DE | 202006007816 | U1 | 8/2006 |
| JP | 08-210011 | | 8/1996 |
| JP | 2000210242 | A | 8/2000 |
| WO | 01/26532 | | 4/2001 |
| WO | 03053191 | A | 7/2003 |

OTHER PUBLICATIONS

International Search Report of PCT/EP2008/003172 Dated Jun. 25, 2008.
European Search Opinion in corresponding European Application No. 07 007 969.4, dated Dec. 27, 2007.

* cited by examiner

*Primary Examiner* — John C Hong
(74) *Attorney, Agent, or Firm* — Banner & Witcoff, Ltd

(57) ABSTRACT

An installation kit assembly and method permit convenient installation of a drawer dishwasher in a cavity of a kitchen worktop, such that the front of the dishwasher is directed out from the cavity, the cavity having at least one inner wall. The installation kit assembly includes at least one fixation device, having a first part and a second part, which are foldably interconnected, at least one fastener for attaching the first part of the at least one fixation device to the inner wall of the cavity, and at least one second fastener for attaching the second part of the one fixation device to the front of the drawer dishwasher.

12 Claims, 11 Drawing Sheets

DRAWER DISHWASHER INSTALLATION KIT ASSEMBLY

This application is a national stage application of co-pending PCT application PCT/EP2008/003172 filed Apr. 21, 2008. The disclosure of this application is expressly incorporated herein by reference in its entirety.

TECHNICAL FIELD

The present disclosure relates to an installation kit assembly for installing a dishwasher. More particularly the disclosure relates to a kit assembly for fastening a drawer dishwasher in an inner wall of a cavity without the necessity to remove the drawer or drawers. The disclosure further relates to a method for installing a drawer dishwasher.

BACKGROUND

When installing a dishwasher, particularly a drawer dishwasher, in for instance a cavity in a kitchen worktop, the installer usually needs to remove the drawer or drawers from the dishwasher frame in order to fasten the dishwasher frame in the walls of the cavity. The dishwasher is usually fastened by means of e.g. a screw, which is screwed from the inside of the dishwasher frame into the inside of the surrounding worktop. The drawer dishwasher also must be properly aligned in the worktop, e.g. with the help of alignment means, in order to be securely fastened. This conventional procedure is shown in the instruction manual "Installation Instructions Single Drawer Dishwasher" from KitchenAid® Home Appliances.

WO 01/26532 discloses the mounting of a drawer dishwasher into a cavity under a bench in a conventional manner wherein the base module of the dishwasher is screwed or bolted to the inside of the cavity before the drawer is placed in the module.

The removal and insertion of the drawer may be difficult. There is hence a need for an installation kit and an installation procedure which is more easily carried out, without the necessity for removing the drawers before fastening the dishwasher frame or chassis in the worktop or walls of the cavity where it is to be placed.

SUMMARY

It is a general object of the present disclosure to provide an improved or alternative installation kit assembly for a drawer dishwasher, which eliminates or alleviates at least some of the disadvantages of the prior art.

According to a first aspect of the invention, there is provided an installation kit assembly for installing a drawer dishwasher in a cavity of a kitchen worktop, such that the front of the dishwasher is directed out from the cavity, the cavity having at least one inner wall, said installation kit assembly comprising at least one fixation means, having a first part and a second part, which are foldably interconnected; at least one first attachment means for attaching the first part of the at least one fixation means to the inner wall of said cavity; at least one second attachment means for attaching the second part of the at least one fixation means to the front of said drawer dishwasher.

By the fixation means being divided into two parts, which are foldably interconnected, the first part may initially be arranged on the inner wall of the cavity and the second part may be locked to the front of the drawer dishwasher subsequently to the drawer dishwasher being inserted into the cavity. Thereby a way of installing the drawer dishwasher without the necessity of removing the drawer or drawers from the dishwasher prior to the fastening of the dishwasher is provided.

By "cavity" is meant e.g. a cavity under a kitchen worktop, a cabinet in the kitchen fixtures or any other suitable space where a dishwasher is required.

By "at least one first attachment means" is meant attachment means for fastening the first part of the fixation means to the inner wall of the cavity, such as e.g. a screw, a bolt, a nail, a tack, a rivet or glue or any other suitable attachment means.

By "at least one second attachment means" is meant any means for fastening the second part of the fixation means to the front in such a way that it is securely locked to the front, e.g. a screw, arranged at the front of the dishwasher or any other suitable means, known to those skilled in the art, for locking the fastening means in a secure manner.

By the fixation means being foldably interconnected the insertion of the dishwasher is facilitated by the optional positioning of the second part outwardly from the cavity for when the dishwasher is to be inserted in the cavity.

By "foldably interconnected" is meant that the two parts of the fixation means are connected for being repeatedly bend or turned without breaking or being worn out. The two parts may be hingedly connected. "Foldably interconnected" first and second parts may also be a fastening strap which is arranged to be firstly arranged with its first part on the inner wall of a cavity and with its second part on the front of the dishwasher.

By the folding of the fixation means around the front of the frame of the dishwasher there is also provided a tilting protection for the dishwasher.

According to an embodiment of the first aspect of the invention, the first part of the fixation means is hingedly connected to the second part of the fixation means.

By the fixation means being hingedly connected there is provided a way of providing foldably interconnected fixation means, which may be repeatedly folded and reset to an aligned state in a reliable manner, which is desirable when e.g. the dishwasher is in need of service or repair and hence needs to be retracted from the cavity wherein it is placed.

According to another embodiment of the first aspect of the invention, the assembly comprises: at least four fixation means, arranged to be placed at at least four different places at at least two different inner walls of a cavity; at least one first attachment means per fixation means and at least one second attachment means per fixation means.

By the kit assembly having fixation means arranged to be placed at both sides of a dishwasher and at least four different places, a stabile and secure fastening of the dishwasher may be achieved.

According to another embodiment of the first aspect of the invention, the first attachment means is a screw.

By the first attachment means being a screw there is provided a secure and easy way of fastening the first part of the fixation means to the inner wall or walls of the cavity.

According to yet another embodiment of the first aspect of the invention, the second attachment means is a screw arranged for co-operation with a threaded opening in the dishwasher.

By the second attachment means being a screw there is provided a secure and easy way of fastening the second part of the fixation means to the front of the dishwasher and also an easy way of releasing the second part when e.g. the dishwasher is in need of service or repair and hence needs to be retracted from the cavity.

According to a second aspect of the invention, there is provided a drawer dishwasher comprising an installation kit assembly according to the first aspect of the invention. By the drawer dishwasher comprising the installation kit there is provided an easy way of installing the dishwasher into desired space, such as a cavity beneath a kitchen desk without the necessity of firstly removing the drawers of the dishwasher.

According to an embodiment of the second aspect of the invention, the drawer dishwasher is provided with at least one recess for fitting the first part of the fixation means.

By the provision of recesses on the sides of the drawer dishwasher there is provided means for sliding the drawer dishwasher onto the fixation to means when inserting the dishwasher, and the dishwasher may also be more securely held in place in the cavity.

According to another embodiment of the second aspect of the invention, the front of the frame of said drawer dishwasher is provided with threaded openings for fastening the second attachment means according to is the first aspect of the solution.

By the drawer dishwasher being provided with threaded openings there is provided means for fastening the fixation means more securely to the drawer dishwasher by a screw. There is also provided an easy way of releasing the second part of the fixation means, when e.g. the dishwasher is in need of service or repair and hence needs to be retracted from the cavity.

According to a third aspect of the present solution there is provided a method for installing a drawer dishwasher in a cavity, the cavity having at least one inner wall, the method comprising the steps of: attaching a first part of at least one fixation means on an inner wall of said cavity by at least one first attachment means; inserting said drawer dishwasher into said cavity with the front of the dishwasher being directed out from the cavity; folding the fixation means 3 such that a second part 5 of the fixation means is arranged against the front 6 of the dishwasher; and fastening said second part to the front of said drawer dishwasher by at least one second attachment means.

Since the fixation means is arranged on the inner wall of the cavity, before the dishwasher is inserted and the fixation means is locked to the dishwasher at the front there is provided, by this method of installing a drawer dishwasher in a cavity, a way of installing the dishwasher without the necessity of removing the drawers of the dishwasher prior to the installation.

BRIEF DESCRIPTION OF THE DRAWINGS

The present solution will in the following be described with reference to the accompanying drawings, wherein.

DETAILED DESCRIPTION

The invention is defined by the appended independent claims. Embodiments are set forth in the appended dependent claims and in the following exemplifying description and drawings.

Figure 1:
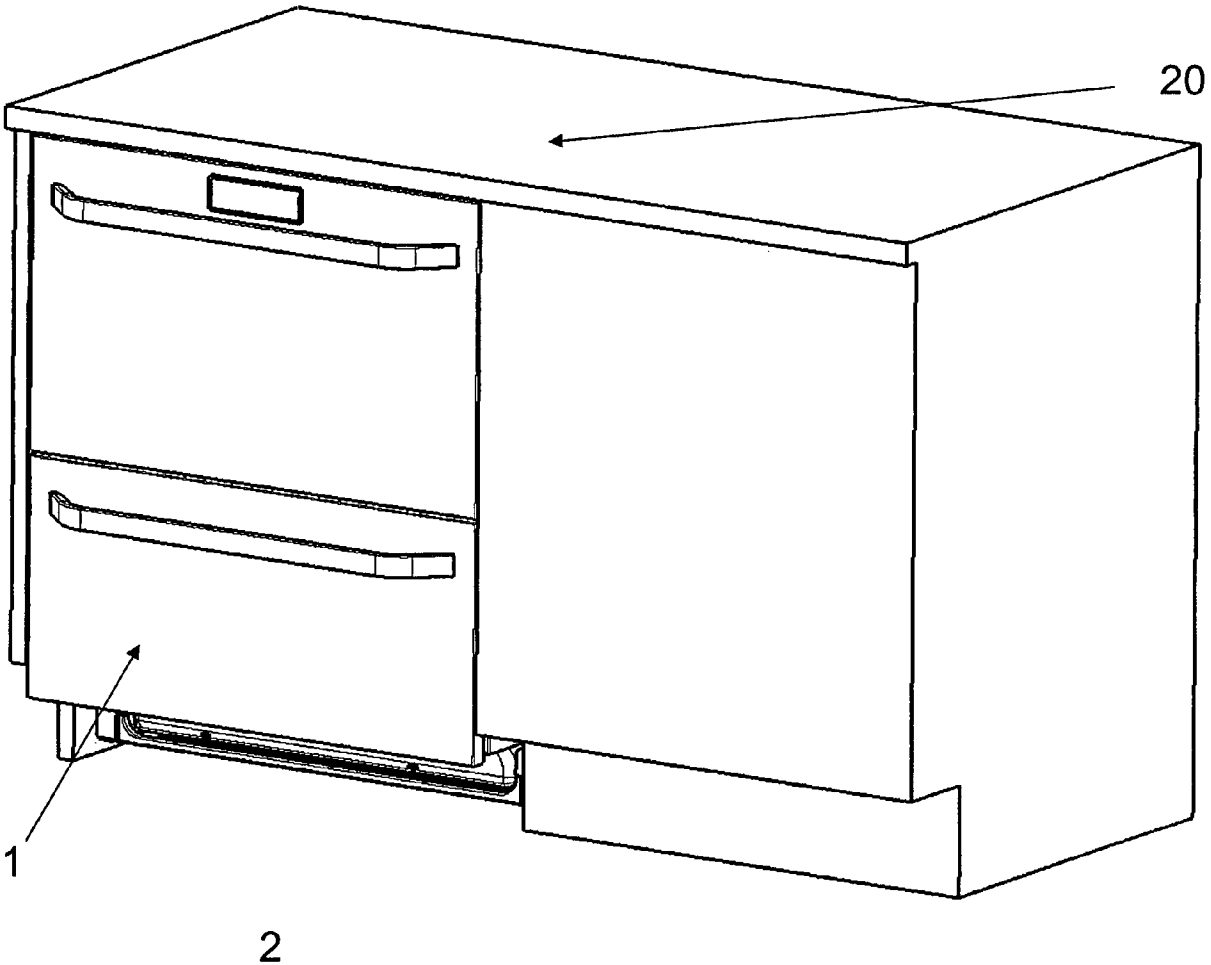
FIG. 1 is a front view of a drawer dishwasher inserted in a cavity of a kitchen worktop.

FIG. 1 illustrate a drawer dishwasher 1, which is fully inserted into a cavity 2 under a kitchen worktop 20, with the front of the dishwasher 1 turned outwardly from the cavity 2.

Figure 2:
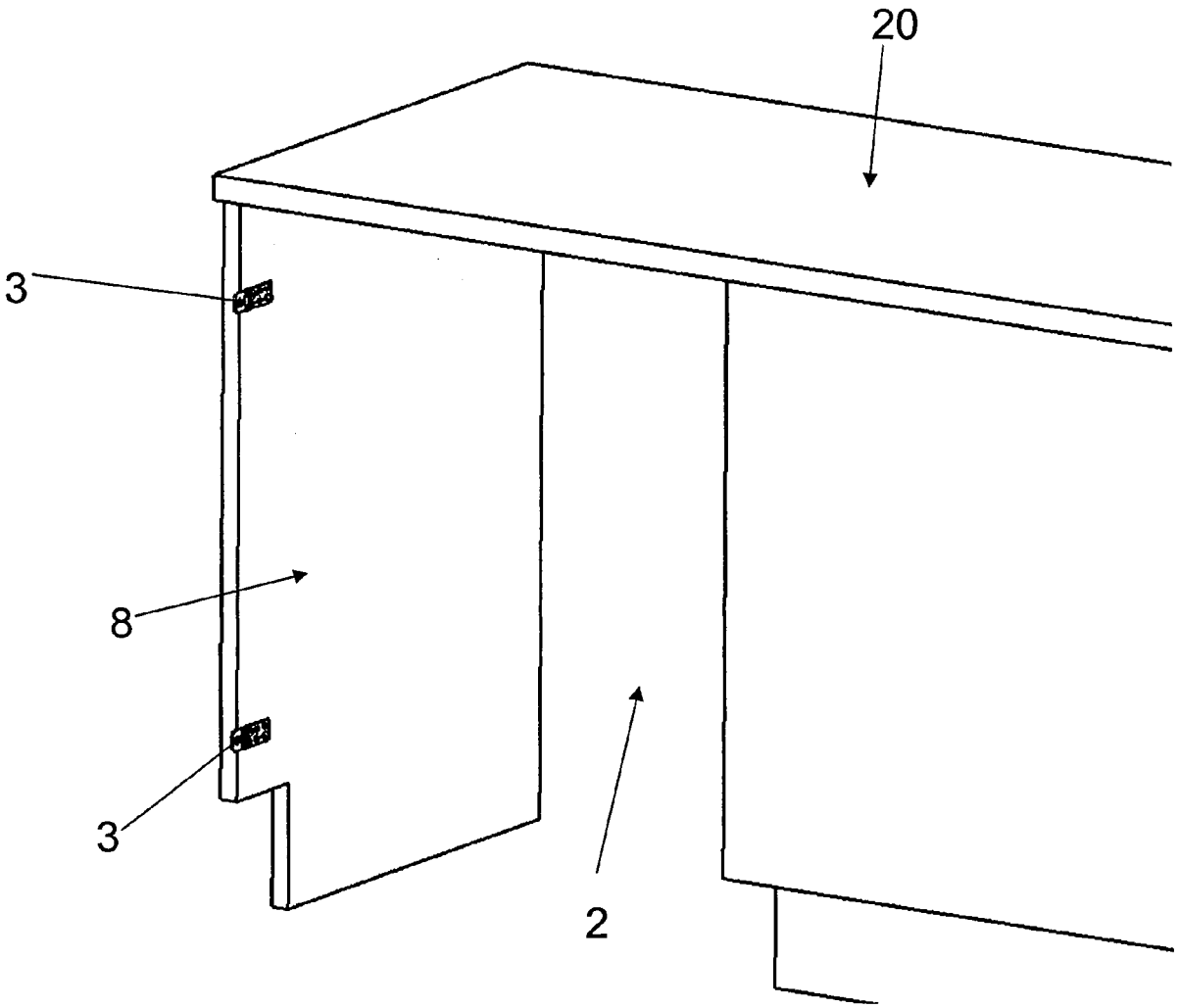
FIG. 2 is a schematic perspective view of a kitchen worktop with a cavity in which fixation means have been arranged.

FIG. 2 illustrate the kitchen worktop 20 with a cavity 2 arranged below a bench of the kitchen worktop. On the inner wall 8 of the cavity 2, fixation means 3 are arranged. In one embodiment the fixation means 3 are arranged on both vertical walls 8 of the cavity. In an alternative embodiment the fixation means 3 are arranged at the upper or lower vertical walls 8 of the cavity 2, i.e. ceiling and floor of the cavity.

Figure 3:
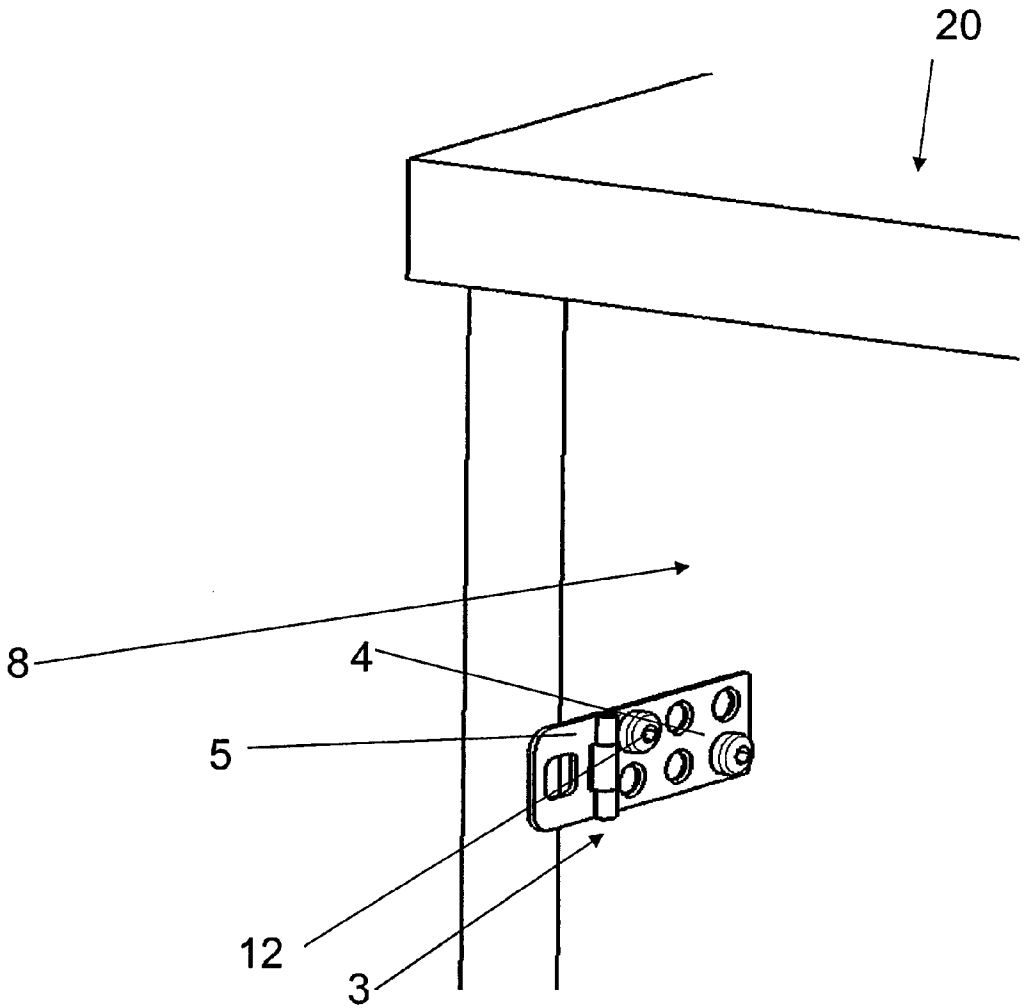
FIG. 3 is a schematic close up view of the fixation means of FIG. 2.

FIG. 3 illustrate a close up view of one fixation means 3 arranged on the inner wall 8 of the worktop. The fixation means 3 has a first part 4 arranged to bear against the inner wall 8 of the worktop and a second part 5 arranged to bear against a front side 6 of the frame of the dishwasher. In FIG. 3, the first part 4 of the fixation means is fastened to the inner wall 8 of the worktop 20 by first attachment means 12. The second part 5 of the fixation means is arranged to be folded around the front side 6 of the drawer dishwasher 1 after the dishwasher has been installed with its drawers. In the embodiment shown in FIG. 3 the two parts 4, 5 of the fixation means 3 are hingedly connected. In an alternative embodiment the fixation means is a fastening strap. The first part 4 of the fixation means is fastened by at least one first attachment means 12 which in one embodiment is a screw. In an alternative embodiment the attachment means 12 is glue. In yet an alternative embodiment the attachment means 12 is a pin, a rivet or a nail.

In FIG. 3, two screws are used for attaching one fixation means 3 to the inner wall 8.

Figure 4:
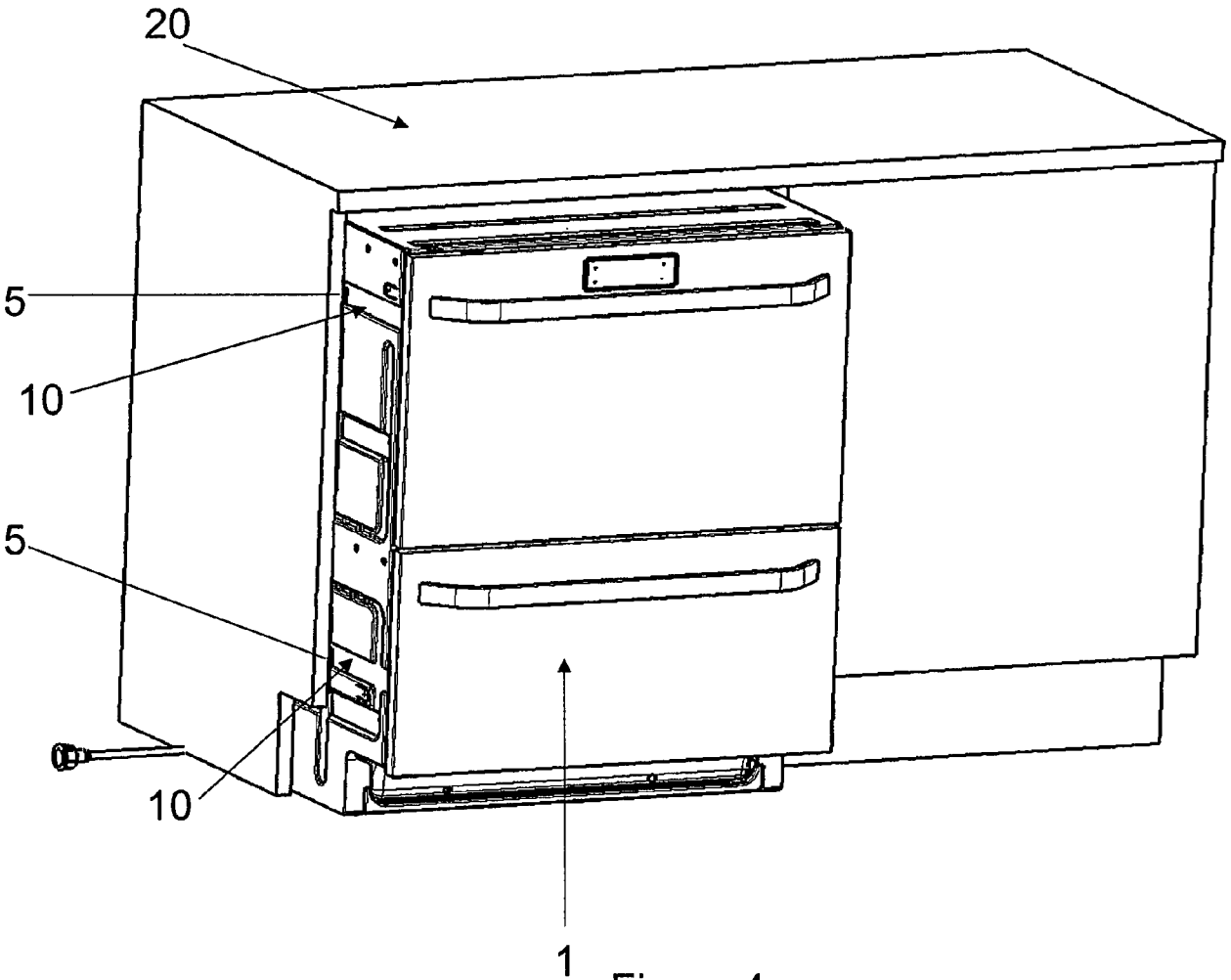
FIG. 4 is a schematic perspective view of a kitchen worktop in which a drawer dishwasher has been partially inserted.

FIG. 4 illustrate a drawer dishwasher 1 partially inserted into a cavity 2 of a kitchen worktop 20, with the front of the dishwasher 1 turned outwardly from the cavity 2. The dishwasher is partially inserted after the number of fixation means 3 have been attached to the inner wall 8 by the first attachment means 12. The fixation means 3 are aligned by alignment means in shape of recesses 10 in the dishwasher. The number of recesses is preferably adapted to the number of fixation means. Before the dishwasher is inserted in the cavity of the kitchen worktop the second part 5 of the fixation means 3 is turned outwardly from the cavity. The recess or recesses 10 is/are formed on the side of the dishwasher chassis to fit with the fixation means 3 so that the dishwasher easily can slide past the fixation means 3 arranged on the inner wall 8. Each recess 10 has a height and depth corresponding to the fixation means 3.

Figure 5:
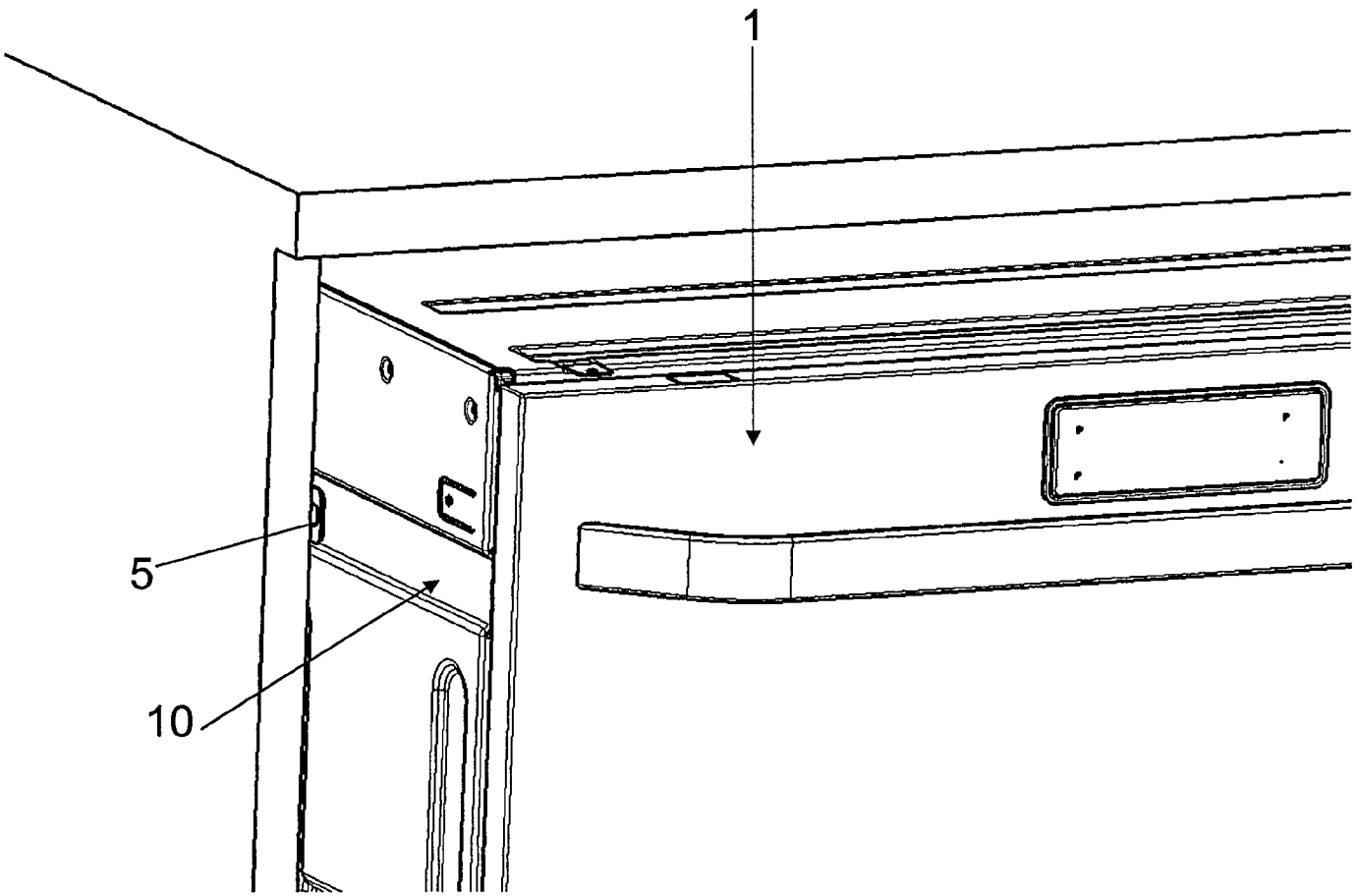
FIG. 5 is a schematic close up view of a part of FIG. 4.

FIG. 5 illustrate a part of a drawer dishwasher 1 partially inserted into the cavity 2 with the front 6 of the dishwasher turned outwardly from the cavity 2. FIG. 5 shows that the second part 5 of the fixation means 3 is aligned with the recess 10 of the dishwasher 1. The second part 5 of the fixation means 3 is turned outwardly from the cavity such that the second part is movable after the dishwasher has been inserted, preferably by aligning the second part with the first part 4 (not shown).

Figure 6:
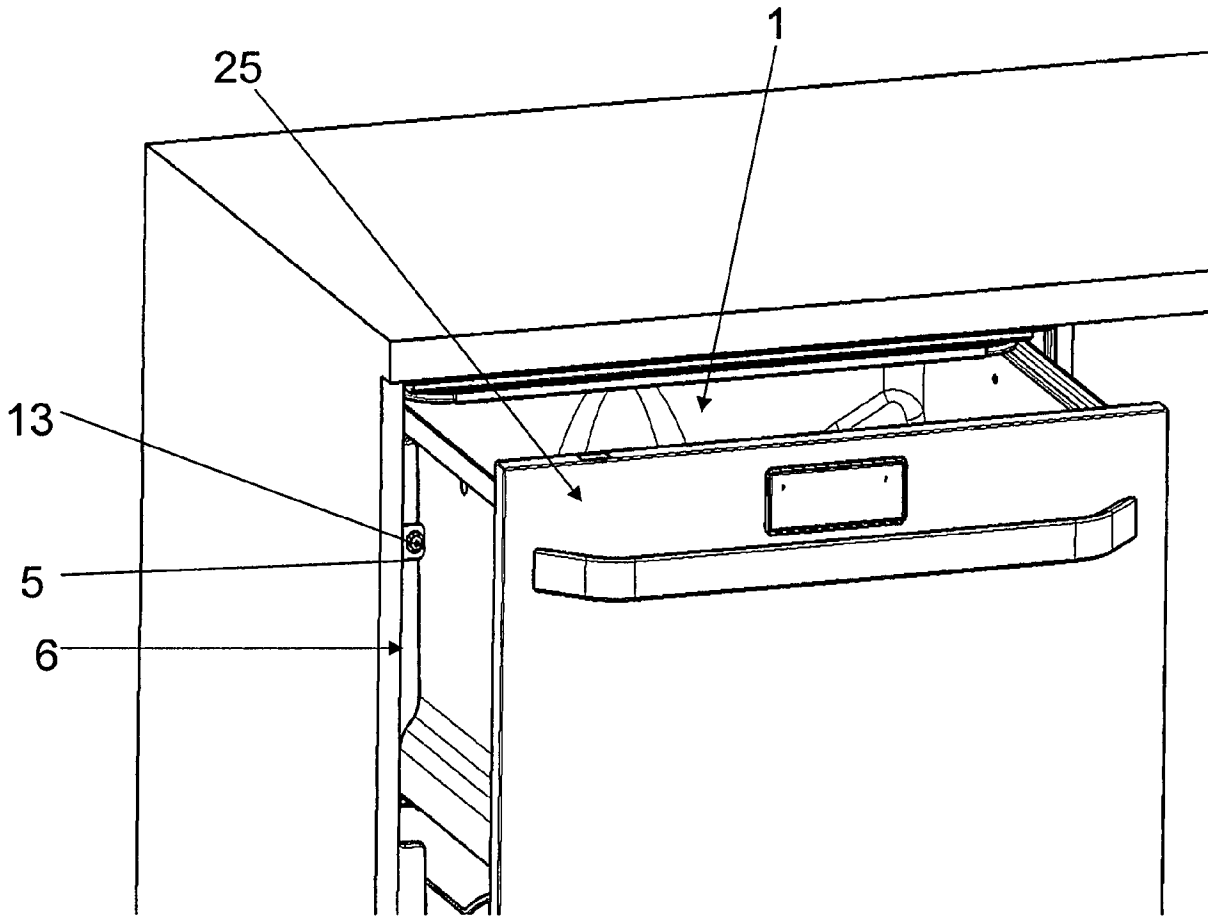
FIG. 6 is a close up, perspective view of a drawer dishwasher inserted into a kitchen worktop with fixation means folded and locked to the front of the drawer dishwasher.

FIG. 6 illustrate a drawer dishwasher 1 fully inserted into the cavity 2. A drawer 25 of the drawer dishwasher 1 is pulled out showing the second part 5 of the fixation means 3 folded around the front side 6 of a frame of the dishwasher 1. The second part 5 is locked to the front side 6 by a second attachment means 13. The front side 6 of the frame of the dishwasher 1 is prepared with an opening 7 (not shown) for receiving the second part 5. In one embodiment the second attachment means 13 is a screw which is fastened in a threaded opening 7 (not shown) at the front side 6 of frame of the dishwasher. In an alternative embodiment the second attachment means 13 is a nut and screw arrangement.

Figure 7:
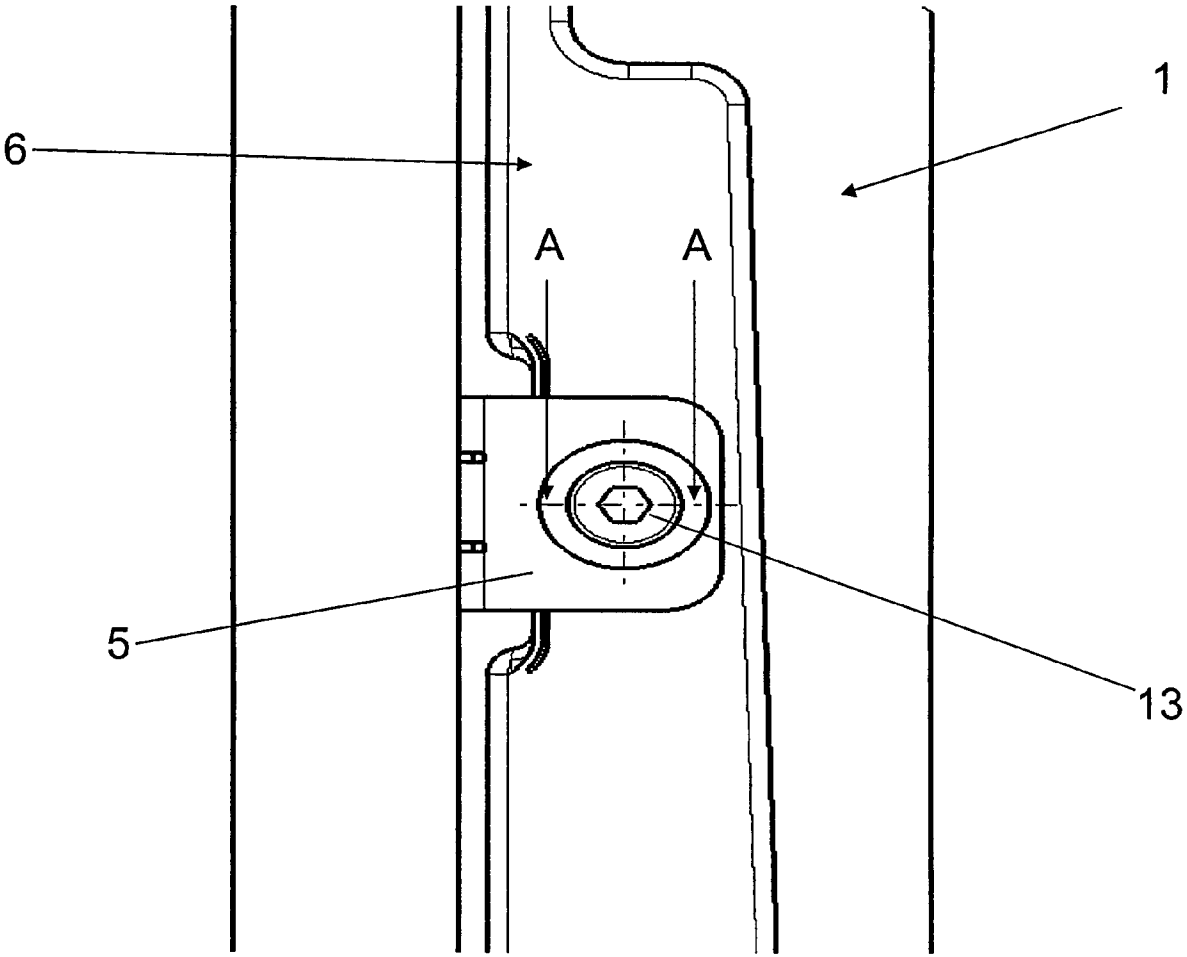
FIG. 7 is a close-up, front view of the fixation means locked to the front of a drawer dishwasher.

FIG. 7 illustrate a front view of the fixation means arrangement arranged on the dishwasher 1. The second part 5 of the fixation means 3 is locked to the front side 6 of the dishwasher 1 frame by the second attachment means 13.

Figure 8:
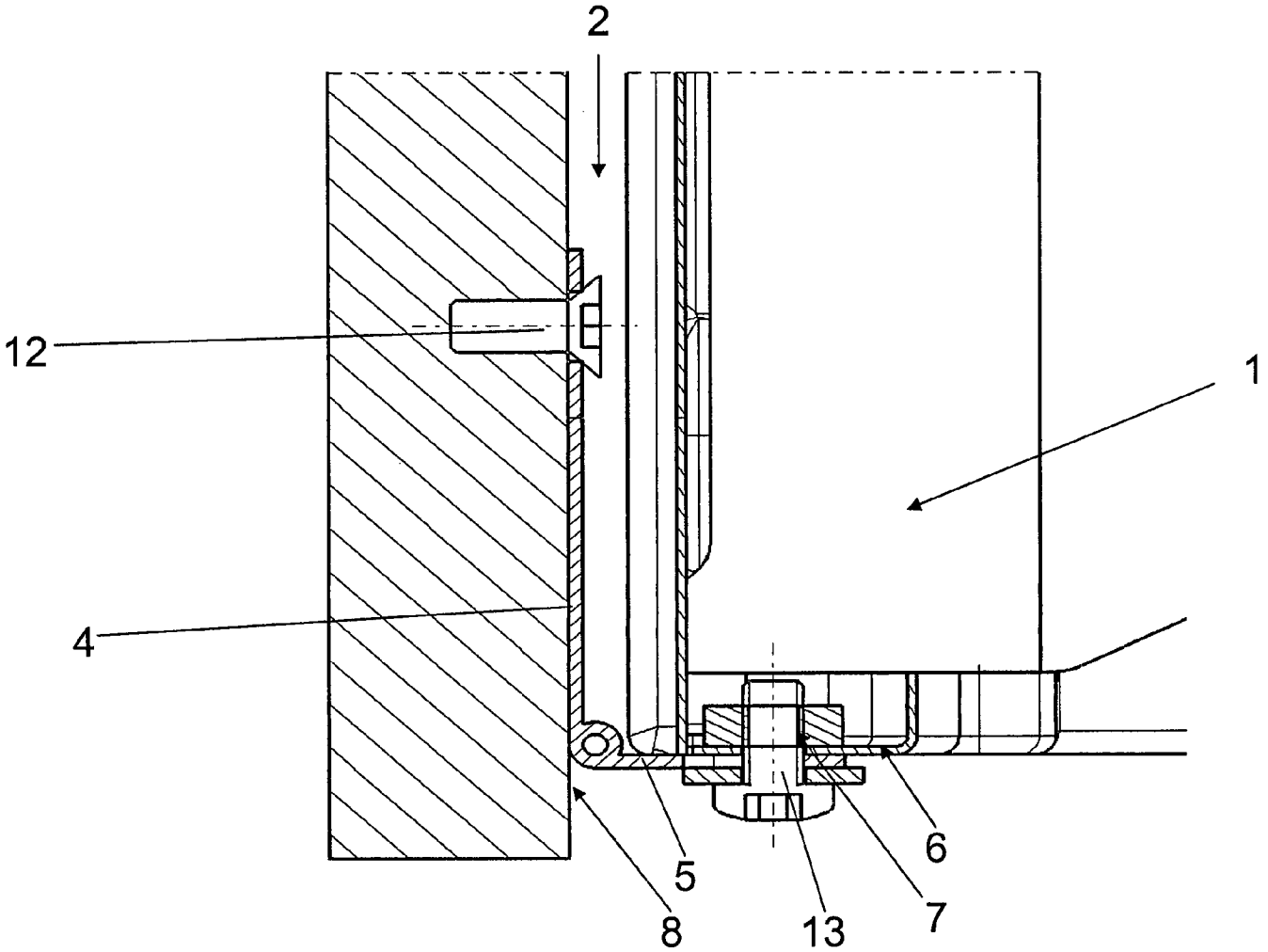
FIG. 8 is a schematic sectional view of the cross section A-A of FIG. 7.

FIG. 8 illustrate the section view A-A of FIG. 7. The first part 4 of the fixation means 3 is arranged to bear against the inner wall 8 of the cavity 2. The first part 4 of the fixation means is attached to the inner wall 8 by a first attachment means 12. The second part 5 of the fixation means 3 is folded around the front side 6 of the drawer dishwasher 1 and is fastened to the front side by the second attachment means 13. In one embodiment the first attachment means 12 is a screw which is screwed into the inner wall 8 to fasten the first part 4. In an alternative embodiment the attachment means 12 is glue. In yet an alternative embodiment the attachment means 12 is a pin, a rivet or a nail. In one embodiment the second attachment means 13 is a screw, which is fastened in the threaded opening 7. In an alternative embodiment the second attachment means is a nut and screw arrangement.

Figure 9:
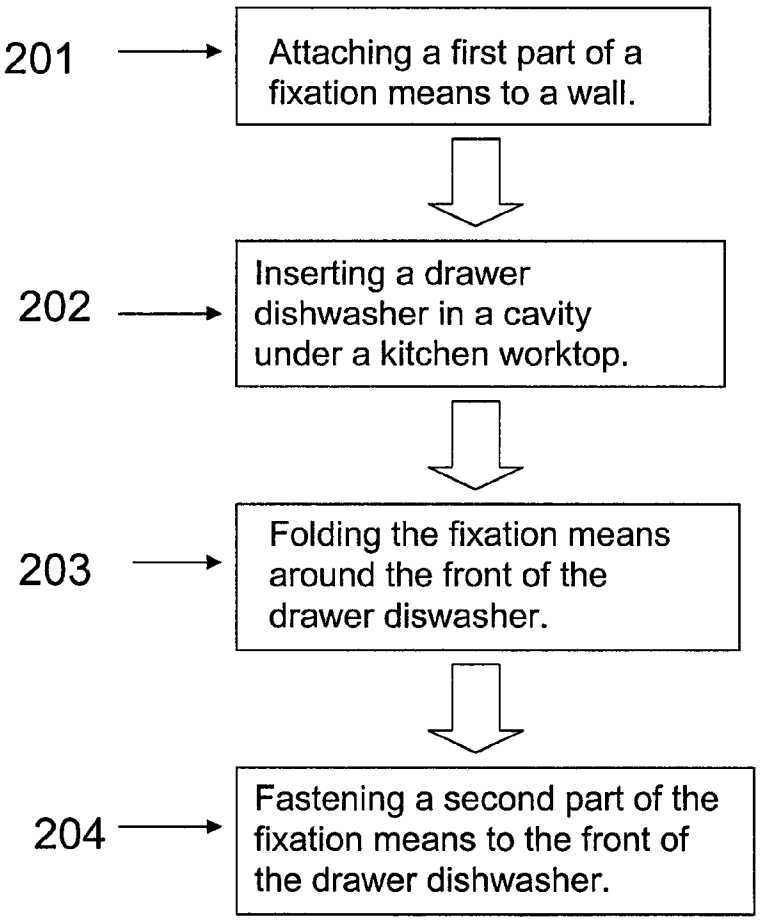
FIG. 9 is a flow chart of the installation procedure.

FIG. 9 illustrate the method for installing a drawer dishwasher 1 according to the present disclosure and will hereinafter be described in one embodiment. The method comprises the following steps:

Attaching 201 the first part 4 of the fixation means 3 to a wall of a cavity of a kitchen worktop using first attachment means 12.

Inserting 202 the dishwasher 1 in the cavity 2. Recesses 10 may be provided as alignment means for fitting together with the fixation means 3. The front side 6 of the drawer dishwasher 1 is directed outwardly from the cavity 2 during the insertion and the second part 5 of the fixation means 3 is turned outwardly from the cavity.

Folding 203 the fixation means 3 around the front 6 of the dishwasher 1 such that the second part 5 is arranged against the front 6 of the dishwasher.

Fastening 204 the second part 5 to the front side of the dishwasher with second attachment means 13.

According to one embodiment the second part 5 of the fixation means 3 is fastened to the front side 6 of the frame of the drawer dishwasher 1, the drawer 25 is therefore slightly pulled out (see FIG. 6) to facilitate the fastening i.e. screwing the screw 13 into the threaded opening 7, before the step of folding the second part.

In one embodiment the front side 6 of the frame of the drawer dishwasher is provided with a plastic cover (not shown), covering the second part 5 and the second attachment means 13 in order to prevent e.g. corrosion of the attachment means 13. The plastic cover is arranged on the front side after the second part of the fixation means has been fastened to the front side of the frame of the dishwasher.

Figure 10:
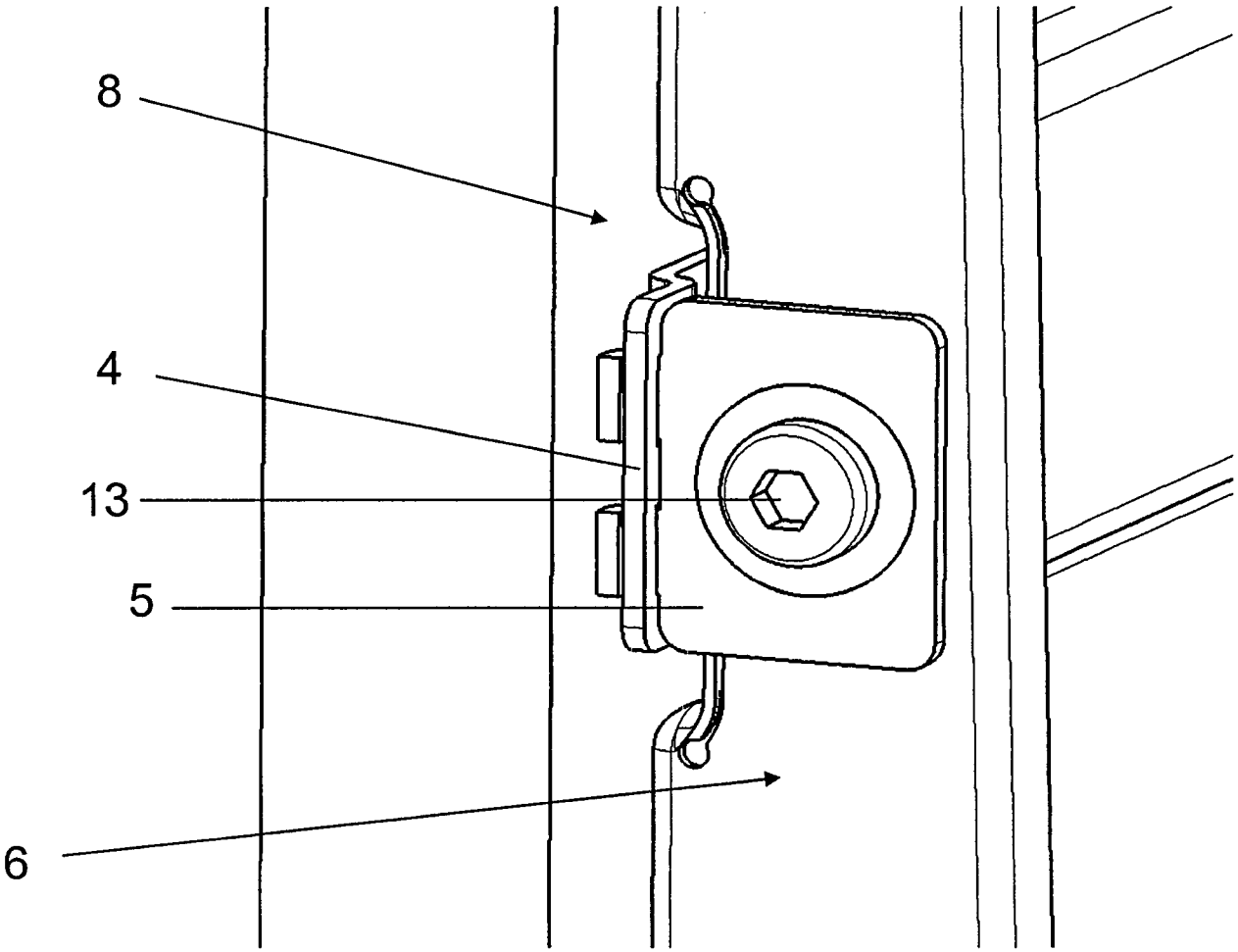
FIG. 10 is a close-up, perspective view of an alternative embodiment of the fixation means.
Figure 11:
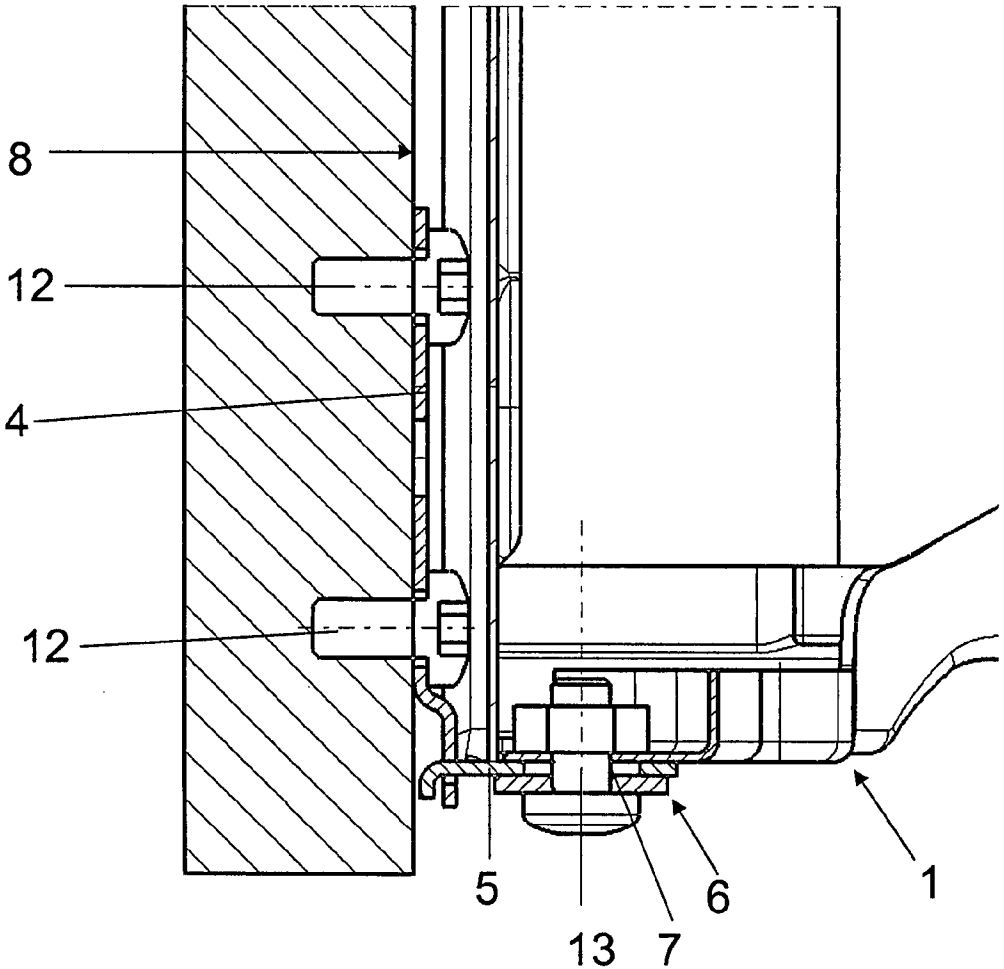
FIG. 11 is a schematic sectional view of the alternative embodiment of FIG. 10.

In FIGS. 10 and 11 an alternative embodiment of the invention is illustrated. The first part 4 of the fixation means 3 is arranged to bear against the inner wall 8 of the cavity 2, by the first attachment means 12. The second part 5 of the fixation means is foldably connected to the first part 4 by being hooked onto the first part 4, when the drawer dishwasher 1 has been inserted into the cavity 2. Subsequently, the second part 5 of the fixation means is arranged to the front 6 of the drawer dishwasher 1 by the second attachment means 13. Thereby, the first 4 and second 5 parts of the fixation means 3 constitute a foldably interconnected portion of an installation kit assembly according to the invention, where the foldably interconnected portion is folded such that the second part 5 can be arranged to the front 6 of the drawer dishwasher 1. This embodiment of the present solution also provides an easy way of releasing the second part 5 from the first part 4 when e.g. the dishwasher is in need of service or repair and hence needs to be retracted from the cavity.

The invention claimed is:

1. A drawer dishwasher installation kit comprising, in combination, (1) a drawer dishwasher appliance having a slidable drawer, and (2) an installation kit assembly for fixedly installing the drawer dishwasher appliance in a cavity of a kitchen worktop, such that a front of the drawer dishwasher appliance is directed out from the cavity, the cavity having at least one inner wall, said installation kit assembly comprising:

at least one fixation means having a first part and a second part, which are foldably interconnected;

at least one first attachment means for attaching the first part of at least one fixation means to the inner wall of said cavity; and at least one second attachment means for attaching the second part of at least one fixation means to the front of the drawer dishwasher appliance to thereby fix the position of the drawer dishwasher appliance in said cavity:

said drawer dishwasher appliance further having at least one recess within which the first part of the fixation means fits both as the dishwasher is inserted into the cavity, and once the position of the drawer dishwasher appliance is fixed in said cavity.

2. The drawer dishwasher installation kit according to claim 1, wherein said first part of the fixation means is hingedly connected to the second part of the fixation means.

3. The drawer dishwasher installation kit according to claim 1, said installation kit assembly further comprising:

at least four fixation means, arranged to be placed at at least four different places at-least two different inner walls of a cavity at least one first attachment means per fixation means and at least one second attachment means per fixation means.

4. The drawer dishwasher installation kit according to claim 2, said installation kit assembly further comprising:

at least four fixation means, arranged to be placed at at least four different places at least two different inner walls of a cavity;

at least one first attachment means per fixation means; and at least one second attachment means per fixation means.

5. The drawer dishwasher installation kit according to claim 1, wherein the first attachment means is a screw.

6. The drawer dishwasher installation kit according to claim 5, wherein the second attachment means is a screw arranged for co-operation with a threaded opening in the dishwasher.

7. The drawer dishwasher installation kit according to claim 1, wherein the first attachment means is a screw; and wherein the second attachment means is a screw arranged for co-operation with a threaded opening in the dishwasher.

8. The drawer dishwasher installation kit according to claim 1, wherein the fixation means is a bracket having a hinge disposed between its first and second parts.

9. The drawer dishwasher installation kit according to claim 1, wherein the fixation means is a strap.

10. The drawer dishwasher installation kit according to claim 1, wherein the front of a frame of said drawer dishwasher appliance is provided with threaded openings for fastening the second attachment means.

11. A method for installing a drawer dishwasher in a cavity, the cavity having at least one inner wall, the method comprising the steps of:

attaching a first part of at least one fixation means on an inner wall of said cavity by at least one first attachment means;

inserting said drawer dishwasher into said cavity along side and past said fixation means to an installed position with a front of the dishwasher being directed out from the cavity;

folding the fixation means such that a second part of the fixation means is arranged against the front of the dishwasher; and fastening said second part to the front of said drawer dishwasher by at least one second attachment means to thereby fix said drawer dishwasher in said installed position.

12. A method according to claim 11, wherein during both said inserting and fastening steps, said first part of the fixation means is fitted within a recess provided in said drawer dishwasher.

* * * * *

UNITED STATES PATENT AND TRADEMARK OFFICE

CERTIFICATE OF CORRECTION

PATENT NO. : 8,448,325 B2
APPLICATION NO. : 12/596561
DATED : May 28, 2013
INVENTOR(S) : Svensson et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 806 days.

Signed and Sealed this
Eighth Day of September, 2015

Michelle K. Lee

Michelle K. Lee
*Director of the United States Patent and Trademark Office*